United States Patent [19]

Van Pelt

[11] Patent Number: 4,792,246

[45] Date of Patent: Dec. 20, 1988

[54] APPARATUS FOR RAISED PRINTING

[75] Inventor: Christopher K. Van Pelt, Venice, Fla.

[73] Assignee: Therm-O-Type Corporation, Nokomis, Fla.

[21] Appl. No.: 659,859

[22] Filed: Oct. 11, 1984

Related U.S. Application Data

[63] Continuation of Ser. No. 433,701, Oct. 12, 1982, abandoned.

[51] Int. Cl.[4] ..... B41J 3/02

[52] U.S. Cl. ..... 400/120; 219/216; 219/388; 219/553; 219/476; 346/76 R

[58] Field of Search ..... 101/426; 400/120; 346/76 R; 219/216, 388, 553, 476

[56] References Cited

U.S. PATENT DOCUMENTS

| | | | |
|---|---|---|---|
| 4,075,455 | 2/1978 | Kitamura et al. | 219/216 |
| 4,079,673 | 3/1978 | Bernstein | 101/426 |
| 4,118,178 | 10/1978 | Calvi et al. | 219/216 |
| 4,180,721 | 12/1979 | Watanabe et al. | 219/216 |

OTHER PUBLICATIONS

"Instruction Book to Get You Started in Raised Printing" Thermo-O-Type Corp. ©Jun. 1981, pp. 1-8.

"Production of Large Area Electrets" NASA Tech. Briefs, Spring 1979, pp. 55-56.

*Primary Examiner*—Eugene H. Eickholt

*Attorney, Agent, or Firm*—Burns, Doane, Swecker & Mathis

[57] ABSTRACT

Raised printing is produced on a printed sheet by applying thermography powder to a top printed surface of the sheet while printed areas on such top surface are tacky, such that the powder adheres to such printed areas and is thereafter melted in a heating section. The heating section comprises an upper heater, a lower heater, and a conveyor for conveying the sheet between the upper and lower heaters such that the upper heater heats the sheet from above while the lower heater heats the sheet from below, to melt and expand the powder.

5 Claims, 4 Drawing Sheets

APPARATUS FOR RAISED PRINTING

This application is a continuation of application Ser. No. 433,701 filed Oct. 12, 1982 now abandoned.

BACKGROUND AND OBJECTS OF THE INVENTION

The present invention relates to thermography or raised printing, and in particular to methods and apparatus for applying heat to printed sheets.

Thermography, or raised printing, is carried out by applying a thermography powder, such as a resin based powder, to a printed sheet while the ink is still tacky. Sufficient heat is applied to melt the powder, whereupon the powder expands and thus imparts a "raised" effect to the printed areas.

Thermography apparatus which has heretofore been employed for carrying-out raised printing operations has usually included a feeder section into which the printed paper sheets are fed. Resinous powder, e.g., a nylon resin, is applied to the printed surface and adheres to the stilltacky ink. Thereafter, excess powder is shaken or sucked from the sheet, leaving powder on the ink only. The sheets are then placed onto a conveyor belt which conveys the sheets through a heat tunnel, with the printed side facing upwardly. An overhead heater, such as an electric resistance heater, heats the sheets and powder to the melting temperature of the powder as the sheets travel through the heating tunnel. As the powder melts, it expands and thus "raises" the printing. Thereafter, the conveyor may conduct the sheets through a cooling tunnel where cooling air is blown against the sheets to solidify the raised print.

Although equipment of this type has been commercially successful, certain problems have occassionally arisen in connection with the heating step in that the sheets sometimes tend to curl when heated. This tendency exists especially in cases where the sheets are damp and the top surface of the sheet dries at a faster rate than the bottom surface. Accordingly, the top surface contracts at a faster rate than the bottom surface, causing the sheet to curl. Curling can also occur in connection with laminated sheets as top and bottom surfaces deform at different rates.

Efforts have been made to mitigate against the curling problem by employing sheets that have been cut such that the grain runs lengthwise. While this practice may reduce the degree of curling to some extent, it is not always practicable or possible to carry out in all cases.

Reliance has been placed upon a vacuum hold-down action in the cooling tunnel in order to straighten-out curled sheets, but this is not always successful and dictates the need for a cooling tunnel even in cases where otherwise not required. Also, the height of the inlet opening of the cooling tunnel must be raised in order to receive curled sheets; this raising of the inlet height reduces the cooling efficiency.

It is, therefore, an object of the present invention to minimize or obviate problems of the above type.

Another object is to provide novel methods and apparatus for applying heat to the sheet in a manner which greatly reduces the sheet-curling problem.

An additional object is to enable the length of a raised printing machine to be reduced, while increasing the rate of production that can be achieved thereby.

SUMMARY OF THE INVENTION

These objects are achieved by the present invention which relates to methods and apparatus for producing raised printing on a printed sheet wherein thermography powder is applied to a top printed surface of the sheet while printed areas on such top surface are tacky, such that the powder adheres to such printed areas and is thereafter melted. The preferred apparatus comprises an upper heater, a lower heater, and means for conveying the sheet between the upper and lower heaters such that the upper heater heats the sheet from above while the lower heater heats the sheet from below, to melt and expand the powder.

By heating the sheet from above and below, it is possible to attain a more uniform drying and/or deformation (expansion, contraction) of the top and bottom surfaces of the sheet, whereby curling of the sheet is reduced.

The corresponding method aspect of the invention involves applying thermography powder to a top printed surface of the sheet while printed areas on such top surface are tacky, such that the powder adheres to the printed areas. The sheet is passed between upper and lower heaters such that the upper heater heats the sheet from above while the lower heater heats the sheet from below, to melt and expand the powder.

Preferably, the upper and lower heaters each comprise an electrical resistance heater. Preferably, the lower heater is of serpentine configuration having parallel portions extending parallel to the direction of travel of the sheet between the heaters, and curved connecting portions interconnecting the ends of adjacent ones of the parallel portions.

THE DRAWINGS

The objects and advantages of the invention will become apparent from the following detailed description of a preferred embodiment thereof, in connection with the accompanying drawings in which like numerals designate like elements, and in which.

DETAILED DESCRIPTION OF A PREFERRED EMBODIMENT OF THE INVENTION

Figure 1:
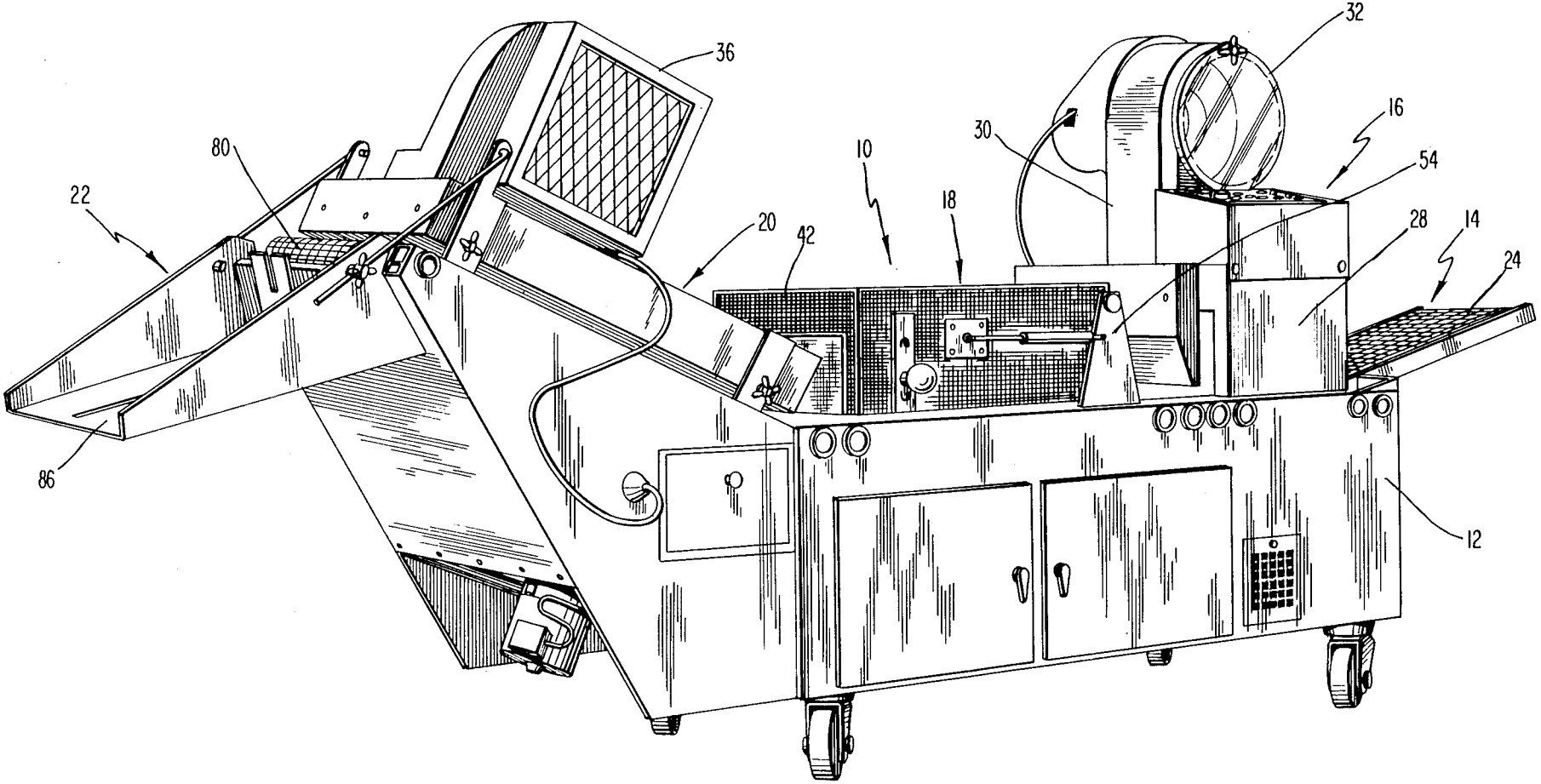
FIG. 1 is a perspective view of a raised printing machine according to the present invention.

A thermography machine 10 according to the present invention comprises a frame 12 which supports a sheet infeed section 14, a powder pick-up section 16, a heating section 18, a cooling section 20, and a discharge section 22.

Figure 2:
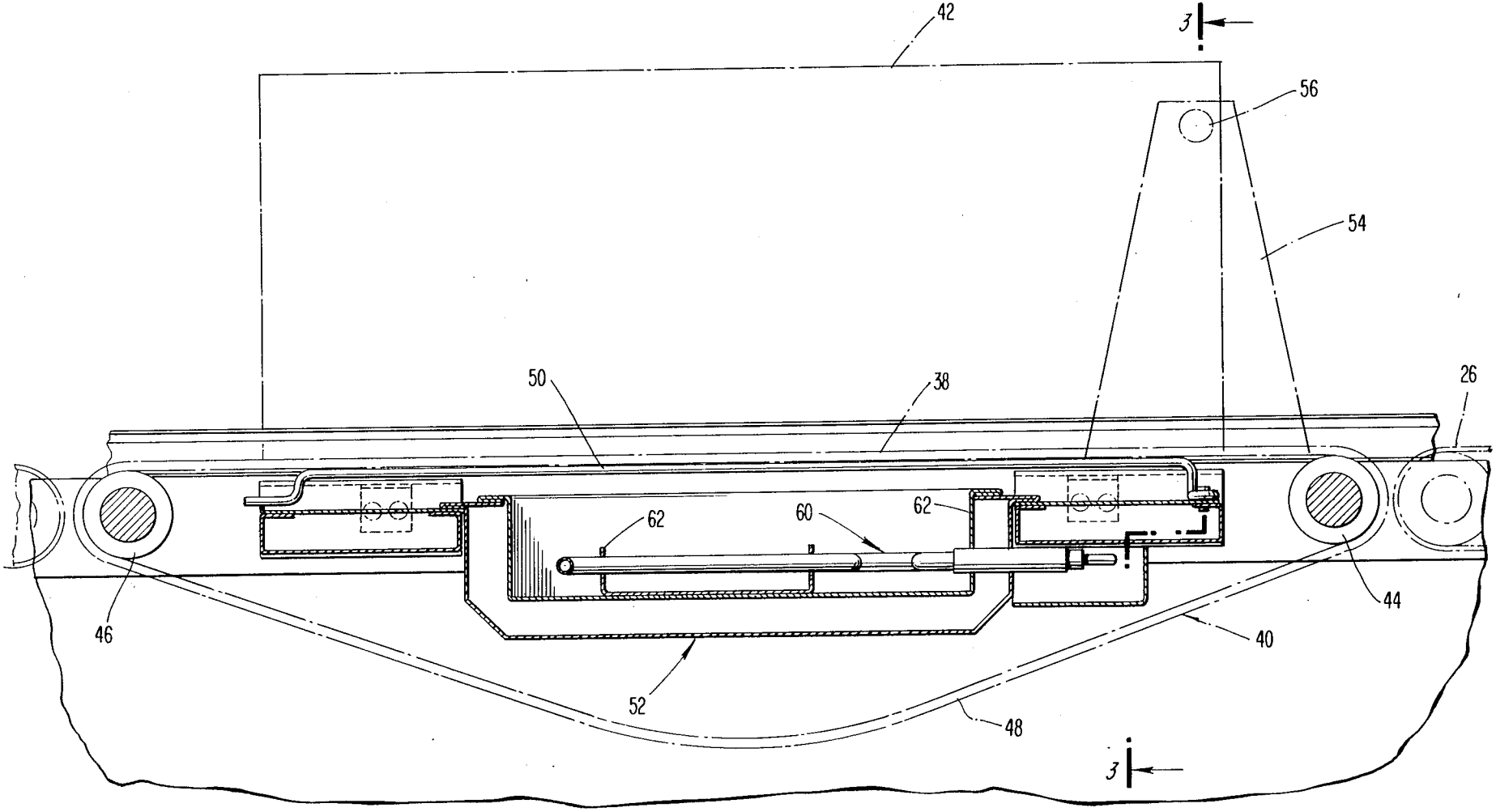
FIG. 2 is a longitudinal sectional view through a sheet heating section, the section being taken along line 2—2 of FIG. 3.

The paper infeed section is conventional and includes one or more driven belts 24 which feeds sheets one-at-a-time to a second belt arrangement 26 (a discharge end of the belt arrangement 26 depicted in FIG. 2), the latter feeding the sheets through the powder pickup section 16. The powder pickup section 16 includes a conventional hopper 28 which applies a thermography powder, e.g., a nylon resin based powder, onto the upwardly facing ink-printed surface of each sheet. The powder must be applied while the ink is still in a tacky state so that the powder adheres to the ink.

Excess powder is sucked from the sheet and belt by a conventional vacuum pickup unit 30 which delivers the powder to a conventional powder separator 32. The separator removes the powder from the air and recirculates that powder back to the hopper.

Figure 4:
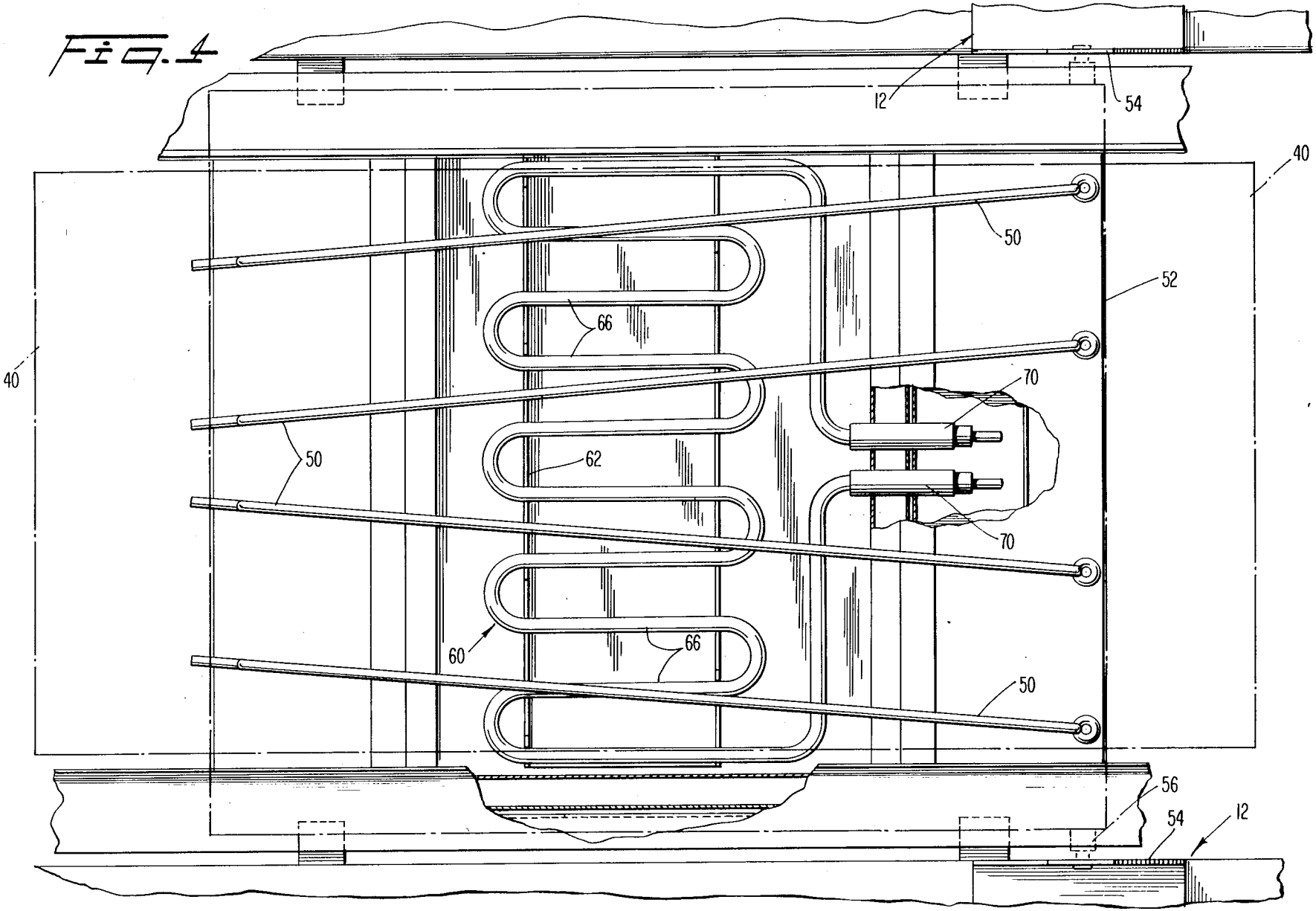
FIG. 4 is a top plan view of a lower heating unit according to the present invention, with the upper flight of a conveyor belt depicted in phantom.

After receiving the powder, the sheets are passed onto the upper flight 38 of a heat-resistant conveyor, such as an endless stainless steel conveyor belt 40 (FIG. 2) which conveys the sheets through a heating tunnel 42 of the heating section 18. This type of belt 40 is perforated and highly heat-resistant. The belt 40 is wrapped around a pair of support rollers 44, 46, one of which is power driven by a conventional variable speed motor (not shown). The conveyor belt contains a slackened lower flight 48, the weight of which pulls the upper flight into frictional engagement with the drive roller to create a positive driving action. A plurality of conventional support rods 50 are mounted on a sub-frame 52 disposed between the upper and lower flights 38, 48 of the chain conveyor 40. These rods 50 extend at an acute angle (FIG. 4) relative to the discretion of travel of the upper flight 38 and are in supportive relationship with the underside of the upper flight. By arranging the support rods at such an angular relationship to the direction of travel, friction-induced wear of the conveyor caused by contact with the rods is distributed along the width of the conveyor.

Figure 3:
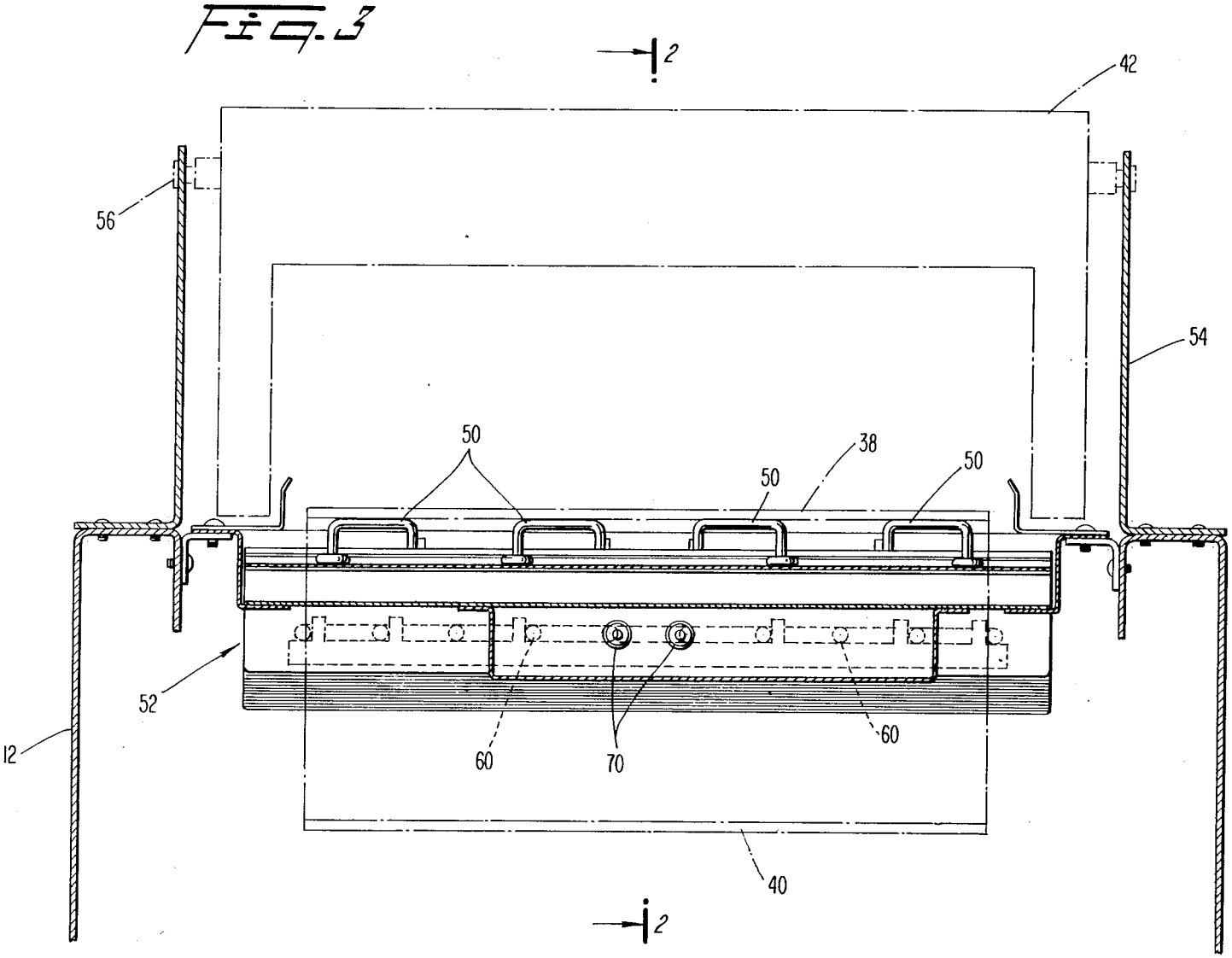
FIG. 3 is a cross-sectional view through the heating section, taken along line 3—3 of FIG. 2.

The heating funnel 42 (shown in phantom in FIGS. 2 and 3) comprises a conventional heater module which is pivotably mounted to a pair of upstanding posts 54 for rotation about a horizontal axis 56 from an operative position to a raised position. The heater module contains an electric resistance heater such as a standard Vycon glass, multi-section, infra-red electric heater which heats the powder and sheets passing therebeneath. As the heated powder melts, it expands, thereby producing the "raised effect".

In practice, the sheet must also be heated to the melting point of the powder before the latter is able to melt sufficiently. As noted earlier, there is on occassion a tendency for sheets to curl while being heated in prior art raised printing machines. This phenomenon has been found to be produced by a number of factors which result in the upper surface of the sheet distorting at a different rate than the bottom surface. For example, if the sheets are damp the upper sheet surface, which is heated at a faster rate, dries and contracts at a faster rate as well, thereby producing the curling action.

In accordance with the present invention, this problem is greatly reduced by an arrangement which provides for the heating of the sheets in the direction of their thickness, thereby avoiding different distortion rates of the upper and lower sheet surfaces.

In accordance with the present invention, there is provided a bottom heater 60 which is situated between the upper and lower flights 38, 48 of the perforate conveyor belt 40. The bottom heater 60 is positioned to heat the sheets from below while the upper heater heats the sheets from above. As a result, the upper and lower sides of the sheets are each heated at a controlled rate. For example, in the case of damp sheets, the upper and lower surfaces can be heated at substantially the same rate to reduce non-uniform deformation which could otherwise result in curling of the sheets.

In the case of laminated sheets formed of layers of different materials having different coefficients of thermal expansion, the bottom and top heaters can be adjusted to produce rates of heating suited to produce the same rate of deformation (expansion or contraction) in both layers.

The bottom heater preferably comprises an electrical resistance heater. One type of such heater which has been successful is a 208 v Calrod which operates at 10 amps. The heater is mounted on support brackets 62 which are suitably affixed to the subframe 52, and is preferably of serpentine configuration whereby parallel portions 66 of the rod extend parallel to the direction of travel of the sheets through the heating section (see FIG. 4), and curved connecting portions 68 interconnect the ends of adjacent ones of the parallel portions 66. The rod includes a standard plug-in section 70.

By heating the sheets simultaneously from above and below, advantages over and above the reduction of the curling problem are achieved. For example, the sheets are heated to the melting point of the powder at a faster rate than heretofore possible when heating was performed solely from above. Accordingly, the length of the upper heater in the direction of conveyor travel can be significantly shortened, thereby shortening the overall length of the machine. Furthermore, the rate of travel of the sheets through the heating tunnel can be increased, thereby increasing the rate of production.

It has also been found that the total energy expenditure for heating the sheets is less when employing top and bottom heaters than when employing only an upper heater. This may result from the fact that the faster throughput rate of the sheets leads to less heat loss to atmosphere per sheet. In any event, the energy efficiency of the present invention is superior to conventional units wherein heating is performed only from above.

At a discharge end of the heating section 18, the chain belt 40 transfers the heated sheets onto another endless stainless steel belt 80 which carries the sheets through a conventional cooling tunnel 82. The cooling tunnel is formed by a vertically adjustable module which contains nozzles (not shown) oriented to direct flows of cooling air onto the sheets. A conventional vacuum hold-down unit (not shown) can be positioned to suck the sheets onto the upper flight of the belt 80 and prevent displacement of the sheets by the air blast.

Sheets discharged from the cooling section fall into a conventional collection tray 86 for subsequent pick-up.

IN OPERATION, printed sheets are fed through the powder pickup section 16 with the printed surface facing upwardly and with the ink in a tacky state. Thermography powder is applied to the upper surface of the sheet and adheres to the ink. Excess powder is sucked from the sheets and the sheets are conducted through the heating tunnel 42. A controlled heating of the sheets from above and below takes place in the tunnel, as heat is directed against the sheet from above as well as from below via the upper and lower heaters.

Thus, a uniform heating of damp sheets and/or laminated sheets can be obtained which prevents curling that could otherwise occur if the sheets were heated only from one side.

When the sheets and powder are heated to the melting point of the powder, the powder melts and expand,, thereby producing the raised printing effect.

After exiting the heating section, the sheets are passed through the cooling section 20 wherein cooling air lowers the temperature of the sheets and solidifies the raised ink.

It will be appreciated that the present invention produces a more uniform heating of the sheets, thereby preventing curling of sheets which would otherwise curl in the presence of uneven heating on opposite sides. The increased rate of heating which is produced by heating from above and below enables the overall length of the machine to be shortened, and permits the production (throughput) rate of the machine to be increased.

Although the present invention has been described in connection with a preferred embodiment thereof, it will be appreciated by those skilled in the art that additions, modifications, substitutions, and deletions not specifically described, may be made without departing from the spirit and scope of the invention as defined in the appended claims.

What is claimed is:

1. In an apparatus for producing raised printing on ink-printed sheets of paper material which includes:

an infeed section for receiving ink-printed sheets containing tacky ink, a powder-pickup station including:

a container of thermography powder, means for conveying said sheets past said container in a manner such that powder is applied to upper printed surfaces of said sheets and adheres to tacky ink thereon, and means for removing excess powder from said sheets, a heating section comprising:

an upper heater for directing heat downwardly, a temperature-resistant perforated conveyor having a flight traveling beneath said upper heater, said conveyor arranged to convey said sheets from said powder-pickup station past said upper heater, the improvement comprising means for resisting curling of the sheets including a lower heater disposed beneath said conveyor for directing heat upwardly so that said sheets are heated simultaneously from above and below to melt and expand said powder, and to produce a substantially uniform heating of the sheets for resisting curling of the sheets and jamming of said sheets in said heating section.

2. Apparatus according to claim 1, wherein said perforate conveyor comprises an endless steel belt having an upper flight traveling between said heaters.

3. Apparatus according to claim 1, wherein said upper and lower heaters each comprise an electrical resistance heater.

4. Apparatus according to claim 3, wherein said lower heater comprises an electrical resistance rod of serpentine configuration having parallel portions extending parallel to the direction of travel of the sheet between said heaters, and curved connecting portions interconnecting the ends of adjacent ones of said parallel portions.

5. Apparatus according to claim 19 including a section downstream of said heating section for directing cooling air against the sheet.

* * * * *